US011938381B2

(12) United States Patent
Horne

(10) Patent No.: US 11,938,381 B2
(45) Date of Patent: Mar. 26, 2024

(54) TRAMPOLINE SCOOTERS

(71) Applicant: Rimack Holdings Limited, Hong Kong (HK)

(72) Inventor: Michael Horne, Kowloon (HK)

(73) Assignee: Rimack Holdings Limited, Hong Kong (HK)

( * ) Notice: Subject to any disclaimer, the term of this patent is extended or adjusted under 35 U.S.C. 154(b) by 0 days.

(21) Appl. No.: 17/675,658

(22) Filed: Feb. 18, 2022

(65) Prior Publication Data

US 2023/0264059 A1 Aug. 24, 2023

(51) Int. Cl.

| | |
|---|---|
| ***A63B 69/00*** | (2006.01) |
| ***A63B 5/11*** | (2006.01) |
| ***A63B 71/00*** | (2006.01) |

(52) U.S. Cl.

CPC ..... *A63B 5/11* (2013.01); *A63B 69/0093* (2013.01); *A63B 71/0054* (2013.01)

(58) Field of Classification Search

CPC ..... A63B 5/11; A63B 5/16; A63B 2071/0063; A63B 71/0054

See application file for complete search history.

(56) References Cited

U.S. PATENT DOCUMENTS

| | | | | |
|---|---|---|---|---|
| 6,139,031 | A | 10/2000 | Wingard | |
| 6,929,267 | B2 | 8/2005 | Sullivan | |
| 8,646,735 | B2 * | 2/2014 | Bradley | F16B 9/054 256/65.02 |
| 11,202,956 | B2 * | 12/2021 | Poutiainen | A63C 5/06 |
| 2005/0017463 | A1 | 1/2005 | Kane | |
| 2021/0093942 | A1 | 4/2021 | Poutiainen | |
| 2021/0101041 | A1 * | 4/2021 | Wilkinson | A63B 5/16 |

(Continued)

FOREIGN PATENT DOCUMENTS

| | | | |
|---|---|---|---|
| AU | 2019289575 | B2 | 12/2019 |
| CN | 2435313 | Y | 6/2001 |
| CN | 204473017 | U | 7/2015 |

(Continued)

OTHER PUBLICATIONS

Lincoln, N.: "We made a Trampoline Scooter!" Jul. 12, 2017 (https://www.youtube.com/watch?v=662g5_ozuas.

(Continued)

*Primary Examiner* — Megan Anderson

(74) *Attorney, Agent, or Firm* — TROUTMAN PEPPER HAMILTON SANDERS LLP; John A. Morrissett; Aaron E. Johnston

(57) ABSTRACT

Disclosed embodiments may include a trampoline scooter device for practicing scooter tricks on a trampoline. The device may include a foam deck with an upper surface and lower surface, where the upper and lower surface both contain a recess. The recesses are designed to receive, respectively, an upper attachment member and a lower attachment member. The upper and lower attachment members and the recesses contain aligned holes to receive connectors. The connectors, or bolts, extend through both attachment members and the deck to secure the deck to the attachment members using nuts. The upper attachment member is connected to the headtube of the scooter via the neck. The headtube contains connections to the column. The column is attached to handlebars containing grips and grip ends.

20 Claims, 4 Drawing Sheets

(56) References Cited

U.S. PATENT DOCUMENTS

2023/0027442 A1* 1/2023 Kramer ..... A63C 17/014

FOREIGN PATENT DOCUMENTS

| | | | |
|---|---|---|---|
| CN | 111971095 | A | 11/2020 |
| DE | 102008063258 | B4 | 9/2010 |
| JP | 2001310008 | A | 11/2001 |
| KR | 200237543 | | 10/2001 |
| KR | 20030039407 | A | 5/2003 |
| WO | 03072415 | A2 | 9/2003 |
| WO | 2019158936 | A1 | 8/2019 |
| WO | 2019243660 | A1 | 12/2019 |

OTHER PUBLICATIONS

International Search Report and Written Opinion in Application No. PCT/GB2019/050415, dated Apr. 18, 2019.

Get Trampoline Expert: Everything You Need to Know about Trampoline Bounce Boards and Skateboards, undated, see in particular embedded video "How to make a trampoline scooter (with tricks),"; https://www.gettrampoline.com/trampoline-articles/trampoline-bounce-boards-skateboards/.

Combined Search and Examination Report in application No. GB1802566.8, dated Aug. 14, 2018, 6 pages.

Extended European Search Report in related EP Application No. 23156777.7, dated Jul. 7, 2023.

* cited by examiner

TRAMPOLINE SCOOTERS

The disclosed technology relates to trampoline scooters and corresponding components and methods of manufacture, assembly, disassembly, repair, and use thereof. Specifically, this disclosed technology relates to trampoline scooters having a more durable and safer connection between the neck and deck.

BACKGROUND

Scooters (as known as kick scooters or push scooters) have been used for transportation and entertainment for nearly a century. Early scooters were often used as a children's toy and are still popular to this day. In more recent times, it has become popular for kids, teenagers, and adults to use scooters recreationally and competitively to learn and perform tricks. Tricks can be practiced in skateparks or arenas and often involve jumping off of or onto custom obstacles such as ramps (made of concrete or wood) and rails (made of metal). Beyond the tricks themselves, landing on such hard materials heightens the risk of injury for a rider even with safety gear such as helmets and pads. The rider is even more at risk when first practicing a new trick, which often involves several failed attempts before the rider is able to land properly.

To allow for safer practice of tricks and an increased range of potential tricks due to higher jumps, some riders prefer to use a modified (e.g., wheel-less) scooter on a trampoline. There the rider can attempt to land the scooter properly, but typically remains uninjured when falling onto the trampoline mat, albeit with some risk of awkwardly landing on the scooter itself. Since the rider will eventually return to the skateparks or arenas to attempt to replicate the new or improved tricks, it is important to balance rider safety on the trampoline with an authentic trick experience so the rider can safely transition away from the trampoline.

Further, while the trampoline mat presents a typically softer landing for the rider, the repeated high jumping of rider and scooter can lead to significant wear and tear on the trampoline mat, which is time-consuming and expensive to replace, and the scooter itself, particularly the connection between its neck (which attaches to or receives the handlebar column) and deck due to forces applied to the handlebars and deck during and when landing a trick. As such, it is important that the scooter is durable and limits damage to the trampoline mat, while also providing a safe and authentic trick experience for the rider.

Accordingly, there is a need for improved trampoline scooters and corresponding components and methods of manufacture, assembly, disassembly, repair, and use thereof. Embodiments of the present disclosure are directed to this and other considerations.

SUMMARY

Disclosed embodiments may include devices and methods for a trampoline scooter. The trampoline scooter may include a deck having an upper surface and a lower surface, an upper recess defined in the upper surface and a lower recess defined in the lower surface. The trampoline scooter may also include an upper attachment member having a top side, wherein the upper attachment member is at least partially received within the upper recess. For example, the trampoline scooter may include a lower attachment member, wherein the lower attachment member is at least partially received within the lower recess. The trampoline scooter may additionally include one or more connectors extending through at least a portion of the deck, the upper attachment member, and the lower attachment member. The trampoline scooter may include a neck having a first end and a second end, the first end attached the top side of the upper attachment member. The trampoline scooter may also include a headtube assembly attachable to the second end of the neck, a column connected to the headtube assembly, and a handlebar connected to the column.

In other embodiments, the trampoline scooter may include a deck having an upper surface and a lower surface, an upper recess defined in the upper surface and a lower recess defined in the lower surface. The trampoline scooter may also include an upper attachment member having a top side, wherein the upper attachment member is at least partially received within the upper recess. Furthermore, the trampoline scooter may include a lower attachment member, wherein the lower attachment member is at least partially received within the lower recess. Additionally, the trampoline scooter may include one or more connectors connecting the upper attachment member, the lower attachment member, and the deck. The trampoline scooter may include a neck having a first end and a second end, the first end attached the top side of the upper attachment member. Finally, the trampoline scooter may include a headtube attached to the second end of the neck.

In further embodiments, the trampoline scooter may include a deck made of a flexible, non-metallic material comprising an upper surface and a lower surface, an upper recess defined in the upper surface. The trampoline scooter may also include an upper attachment member having a top side, wherein the upper attachment member is at least partially received in the upper recess. Additionally, the trampoline scooter may include a neck having a first end and a second end, the first end attached the top side of the upper attachment member. Finally, the trampoline scooter may include a headtube attached to the second end of the neck.

Further implementations, features, and aspects of the disclosed technology, and the advantages offered thereby, are described in greater detail hereinafter, and can be understood with reference to the following detailed description, accompanying drawings, and claims.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings.

DETAILED DESCRIPTION

Examples of the present disclosure are related to systems and methods for a trampoline scooter. Trampoline scooters allow a rider to practice tricks while on a trampoline, which is a safer learning environment for riders. The trampoline provides riders with the ability to perfect their moves before trying them out on a conventional street scooter and potentially crash landing onto a hard surface. Furthermore, practicing scooter tricks using a trampoline scooter provides its own challenges and entertainment for riders. The trampoline scooters disclosed herein are specifically designed to be both durable and emulate the trick experience of a conventional street scooter, yet be safe for use on a trampoline for both rider and trampoline. The disclosed trampoline scooter may use a foam deck or deck constructed of other soft materials, which does not damage the trampoline mat. The foam deck also is lightweight and will not hurt the feet of a rider if it collides with them while bouncing or landing. Furthermore, the handlebar column may extend at an angle in front of the deck to mimic a conventional street scooter, which aids the rider in learning new tricks and transitioning back to non-trampoline (e.g., skatepark or arena) riding.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed devices and methods.

Reference will now be made in detail to example embodiments of the disclosed technology that are illustrated in the accompanying drawings and disclosed herein. Wherever convenient, the same reference numbers will be used throughout the drawings to refer to the same or like parts.

Figure 1:
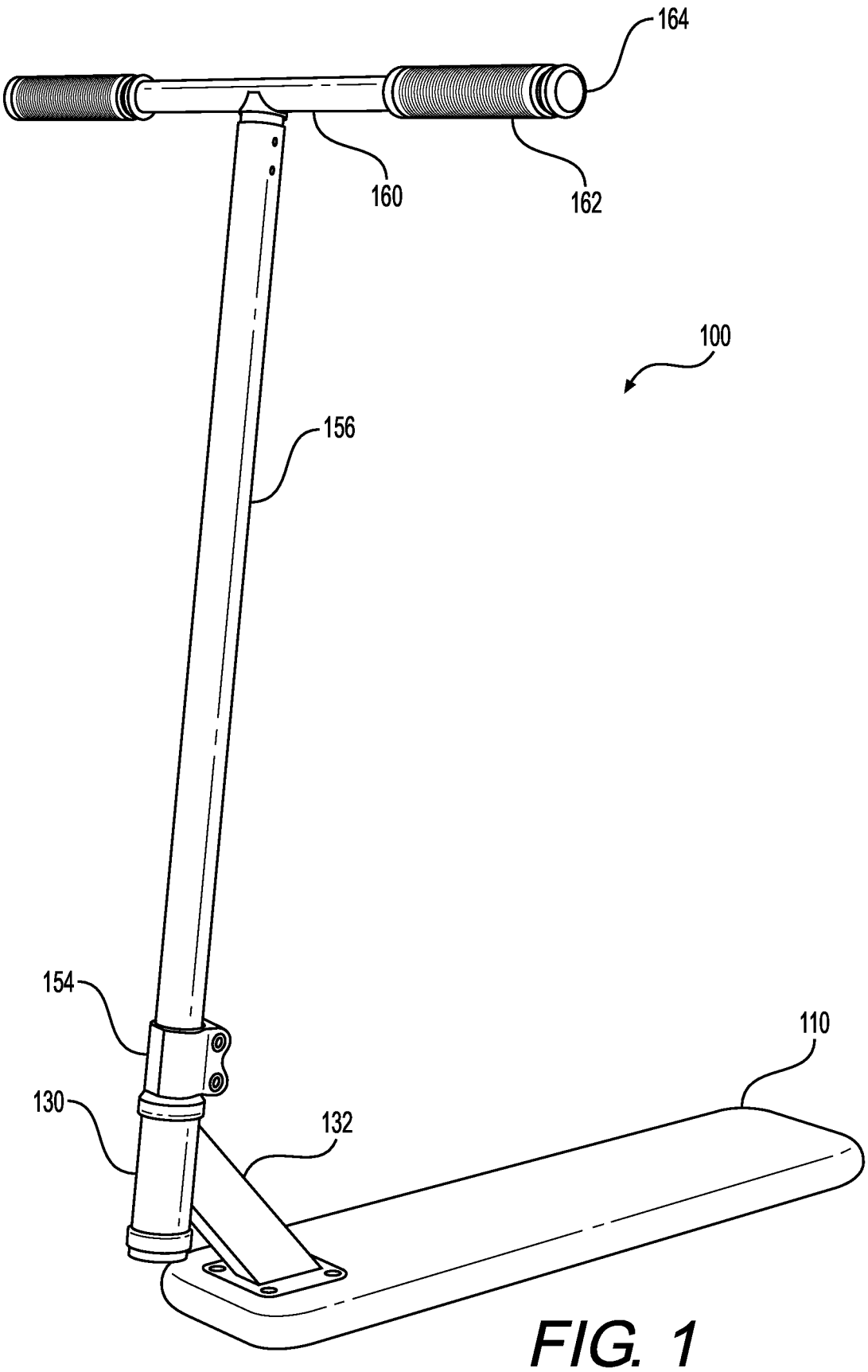
FIG. 1 is an elevated left side perspective view of a trampoline scooter in accordance with certain embodiments of the disclosed technology.

FIG. 1 illustrates an exemplary trampoline scooter 100 in accordance with some embodiments. Trampoline scooter 100 may include a deck 110, headtube 130 with neck 132, a column 156, and handlebars 160. The handlebars 160 may contain grips 162 and grip ends 164 to prevent the rider's hands from slipping off the handlebars 160. The neck 132 may connect the deck 110 to the headtube 130. The headtube 130 may contain a fork 150 (not pictured in FIG. 1), which may be attached to the column 156 using a clamp 154. The headtube 130 may extend beyond the front of the deck 110.

Figure 2:
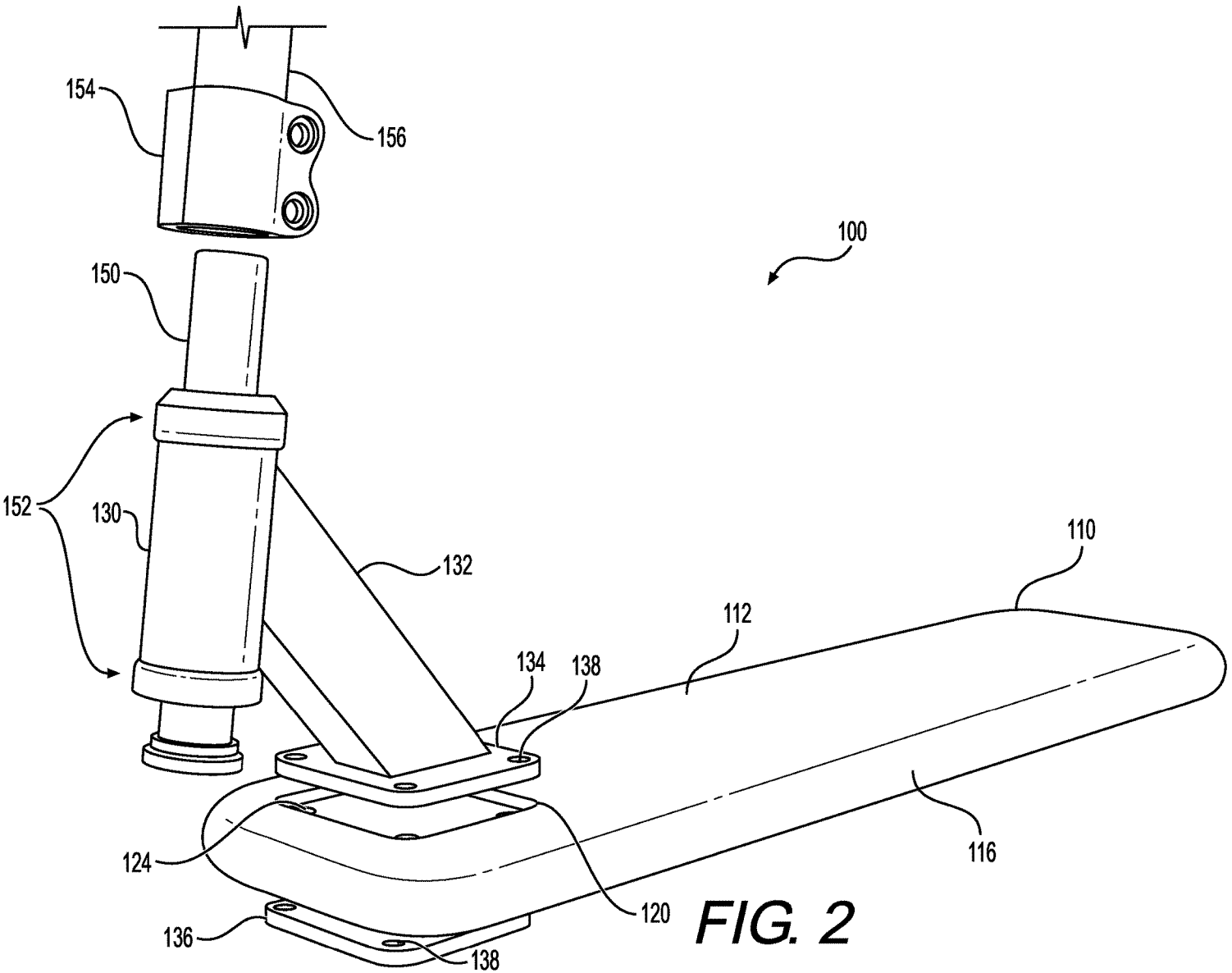
FIG. 2 is an exploded detailed left side view of the attachment mechanism of a trampoline scooter of FIG. 1.

FIG. 2 is an exploded close-up view of an exemplary trampoline scooter 100 in accordance with some embodiments. The deck 110 may include an upper surface 112, lower surface 114, and sides 116. The deck may be made from ethylene-vinyl acetate foam or a similar type of durable foam or plastic. The upper surface 112 may be flat for easy use by riders. The lower surface 114 may be flat or convex to aid in the deck 110 landing on the trampoline at a non-flat angle. The sides 116 may include a front, back, left, and right side and may be filleted, curved, or contoured to prevent sharp edges that could get caught on the trampoline mat.

The deck 110 may also include an upper recess 120 in upper surface 112, designed to receive at least a portion of the upper attachment member 134 connected to the neck 132. The upper recess 120 may be designed to be the same depth as the upper attachment member 134 so that the exterior (top) surface of the upper attachment member 134 is flush with the upper surface 112. The lower surface 114 may also include a lower recess 122, designed to receive at least a portion of the lower attachment member 136. The lower recess 122 may be designed to be the same depth as the lower attachment member 136 so that the exterior (bottom) surface of the lower attachment member 136 is flush with the lower surface 114. If the lower surface 114 is convex, the lower attachment member 136 may contain a bottom surface that has a convex shape to match the lower surface 114. The upper surface 112 and/or the lower surface 114 may contain ornamental lettering, a manufacturer's logo, or other designs. In some examples, the upper attachment member 134 and the lower attachment member 135 may be completely received (or countersunk) within the upper recess 120 and lower recess 122, respectively, which can decrease the risk of an exposed edge of the upper attachment member 134 and the lower attachment member 135 injuring the rider or damaging the trampoline mat.

The deck 110 may also include one or more holes 124, which may at least partially extend from the upper recess to the lower recess. The holes 124 may be through holes that extend vertically (e.g., perpendicularly to the plane of the upper surface 112) through the deck 110. The holes 124 may also align with holes in the upper attachment member 134 and/or the lower attachment member 136 to allow for connectors to extend through them. Holes 124 may be entirely or partially threaded.

The upper attachment member 134 may be made of hard materials, such as metal, notably aluminum or steel, or a durable plastic. The upper attachment member 134 may be in the form of a plate. The plate may be a rectangle, square, or be any assortment of shapes, and may have a larger horizontal cross-section than the neck 132 to better distribute forces applied to, and in turn increase durability of, the deck 110. The upper attachment member 134 may have a top side and a bottom side. The corners of upper attachment member 134 may be rounded or curved. The upper attachment member 134 may be received entirely within the upper recess 120, or may protrude from the upper recess 120 slightly. It is advantageous to prevent parts from protruding or only allow parts to minimally protrude beyond the upper surface 112 of the deck 110 because parts could easily catch on the rider's feet, which are typically barefoot or only covered by socks when using a trampoline. In an example, the upper attachment member 134 having a shape extending too far toward the rear of the deck 110 may create a leverage point that could cause the deck 110 to fracture along a horizontal axis. Therefore, the shape of the upper attachment member 134 may be equal on all sides to provide an even spread of downward force when pulling back on the handlebars 160.

The upper attachment member 134 may have one or more through holes 138. Holes 138 may extend through the thinnest dimension of the plate. Holes 138 may be designed to receive a threaded or unthreaded portion of a bolt. Holes 138 may be entirely or partially threaded. Holes 138 may be perpendicular to the largest plane of the upper attachment member 134. Holes 138 may be vertical and holes 138 may also be aligned with holes 124 in the deck and other holes 138 in the lower attachment member 136. Holes may contain a countersunk portion or countersinks 140 to make bolt heads or nuts flush with the top surface of the upper attachment member 134. Holes may be positioned near the corners of the upper attachment member 134. In one example, positioning the holes near the corners of the upper attachment member 134 may be advantageous by making it simple to adjust the compression of the deck 110 between upper attachment member 134 and lower attachment member 136.

The lower attachment member 136 may be made of hard materials, such as metal, notably aluminum or steel, or a durable plastic. The lower attachment member 136 may be in the form of a plate. The plate may be a rectangle, square, or be any assortment of shapes, and may have a shape and horizontal cross-section that matches that of the upper attachment member 134. The lower attachment member 136 may have a top side and a bottom side. The corners of the lower attachment member 136 may be rounded or curved. In an example, the lower attachment member 136 having a shape extending too far toward the rear of the deck 110 may create a leverage point that could cause the deck 110 to fracture along a horizontal axis. Therefore, the shape of the lower attachment member 136 may be equal on all sides to provide an even spread of downward force when pulling back on the handlebars 160.

The lower attachment member 136 may have one or more holes 138. Holes 138 may extend through the thinnest dimension of the plate. Holes 138 may be designed to receive a threaded or unthreaded portion of a bolt. Holes 138 may be entirely or partially threaded. Holes 138 may be perpendicular to the largest plane of the lower attachment member 136. Holes 138 may be vertical and holes 138 may also be aligned with holes 124 in the deck and other holes 138 in the upper attachment member 134. Holes 138 may contain a countersunk portion or countersinks 140 to make bolt heads or nuts flush with the bottom surface of the lower attachment member 136. Holes may be positioned near the corners of the lower attachment member 136. In one example, positioning the holes near the corners of the lower attachment member 136 may be advantageous by making it simple to adjust the compression of the deck 110 between upper attachment member 134 and lower attachment member 136.

Connectors (not pictured) may include bolts and nuts, screws, or other mechanical fasteners. Bolts may be used to extend downwardly through the holes 138 in the upper attachment member 134, the holes 124 in the deck 110, and the holes 138 in the lower attachment member 136. The bolts may contain a threaded portion and an unthreaded portion. Nuts may be used on the opposing surface to tighten the bolts. By using the connectors to pull the upper attachment member 134 and lower attachment member 136 together, the deck is secured to the neck 132 and headtube 130 using compression. This provides a secure and stable connection between the deck 110 and metal neck 132 and headtube 130. The connectors may also include bolts with inner threads and/or nuts with inner threads. Using bolts and/or nuts with inner threads eliminates the sharp edges of the threads from touching the deck 110 of foam. The sharp edges of threads facing into the deck may perforate the deck 110 and create weak points in the foam that would be prone to tearing or cracking.

In one example, using nuts and bolts can aid in achieving equal compression of the deck 110 at each connection point between upper attachment member 134 and lower attachment member 136, which may be important for properly securing deck 110 to the handlebar assembly. This also allows the user to change out the deck 110 for repairs (e.g., a broken deck 110) or for aesthetics (e.g., different color deck 110). By using holes and nuts/bolts at the corners of the upper attachment member 134 and lower attachment member 136, the user can adjust the compression of each corner manually (e.g., by turning the bolts in quarter-turn increments in a crisscross pattern) to maintain the secure connection of deck 110 to the metal neck 132 and headtube 130. The amount of compression needed may be specific to the material of the deck 110 that is used (e.g., an ethylene-vinyl acetate deck may require less compression than a plastic deck).

The connectors may also include studs attached to the upper attachment member 134 or the lower attachment member 136 such that the studs can extend through the holes 124 in deck 110. Nuts may then be used to secure the studs in a similar manner as the bolts. The connectors may have protective covers that extend over sections that protrude from above upper attachment member 134 or below lower attachment member 136 (i.e., bolts may have protective covers extending over the head section or threaded section that sticks beyond the holes 138). The connectors may extend in a direction perpendicular to the upper surface 112 of the deck 110.

The connectors may also include anchors. The anchors may be drilled into the foam of deck 110 perpendicularly to the upper surface 112 or at a different angle. The anchors may attach to the lower attachment member 136 or replace the need for the lower attachment member 136 or the lower recess 122. Alternatively, the upper attachment member 134 and/or the lower attachment member 136 could be attached to the deck 110 by other appropriate means such as adhesives or glue.

In other examples, the upper attachment member 134 and/or the lower attachment member 136 may include connectors in lieu of holes 138, and such connectors may extend through the holes 124 in the deck 110 and be secured to mating connectors or holes 138 of the opposing attachment member. Further, the upper attachment member 134 or the lower attachment member 136 may include threaded ends in lieu of holes 138 such that bolts, screws, or other connectors can be directly attached and tightened into the threaded ends in lieu of using nuts.

The headtube 130 may be a hollow cylindrical (or tubular) shape. The neck 132 may attach to the side of the headtube 130. The neck 132 may extend down a majority of the headtube 130. The neck 132 may be attached to headtube 130 by welding or may be of integral construction with the headtube 130. At the opposing end of where the neck 132 may attach to the headtube 130, the neck 132 may attach to the upper attachment member 134. The neck 132 may have a rectangular or square cross-section where it attaches to the upper attachment member 134 or along its length. The upper attachment member 134 may have a larger or smaller area than the cross-sectional area of the neck 132. The upper attachment member 134 may be attached to the neck 132 by welding or may be of integral construction with the neck 132. The headtube 130, the neck 132, and the upper attachment member 134 may be made of hard materials, such as metal, notably aluminum or steel, or a durable plastic.

The headtube 130 may receive a fork 150. The headtube 130 may contain a receiver mechanism for receiving the fork 150. The fork 150 may be a cylindrical shape with one end wider than the other so that it cannot travel through the headtube 130. The fork 150 may include a mock wheel for practicing tricks on the wide end. A segment of the fork 150 may be secured to the headtube 130 by headset parts 152. The headset parts 152 may contain bearings that allow the fork 150 to spin while being attached to the headtube 130. This allows the handlebars 160 and column 156 to turn. The column 156 may slide over the top of the fork 150. The column 156 may then be attached to fork 150 using clamp 154. The clamp 154 may contain features to insert screws or bolts (not pictured). Screws or bolts may be used to tighten the clamp 154 to secure the column 156 to the fork 150. Alternatively, the column 156, the headtube 130, and the fork 150 may be of integral construction in a fixed-handlebar example of the trampoline scooter 100. The headtube assembly may refer to the headtube 130, the fork 150, headset parts 152, and/or the clamp 154.

Figure 3:
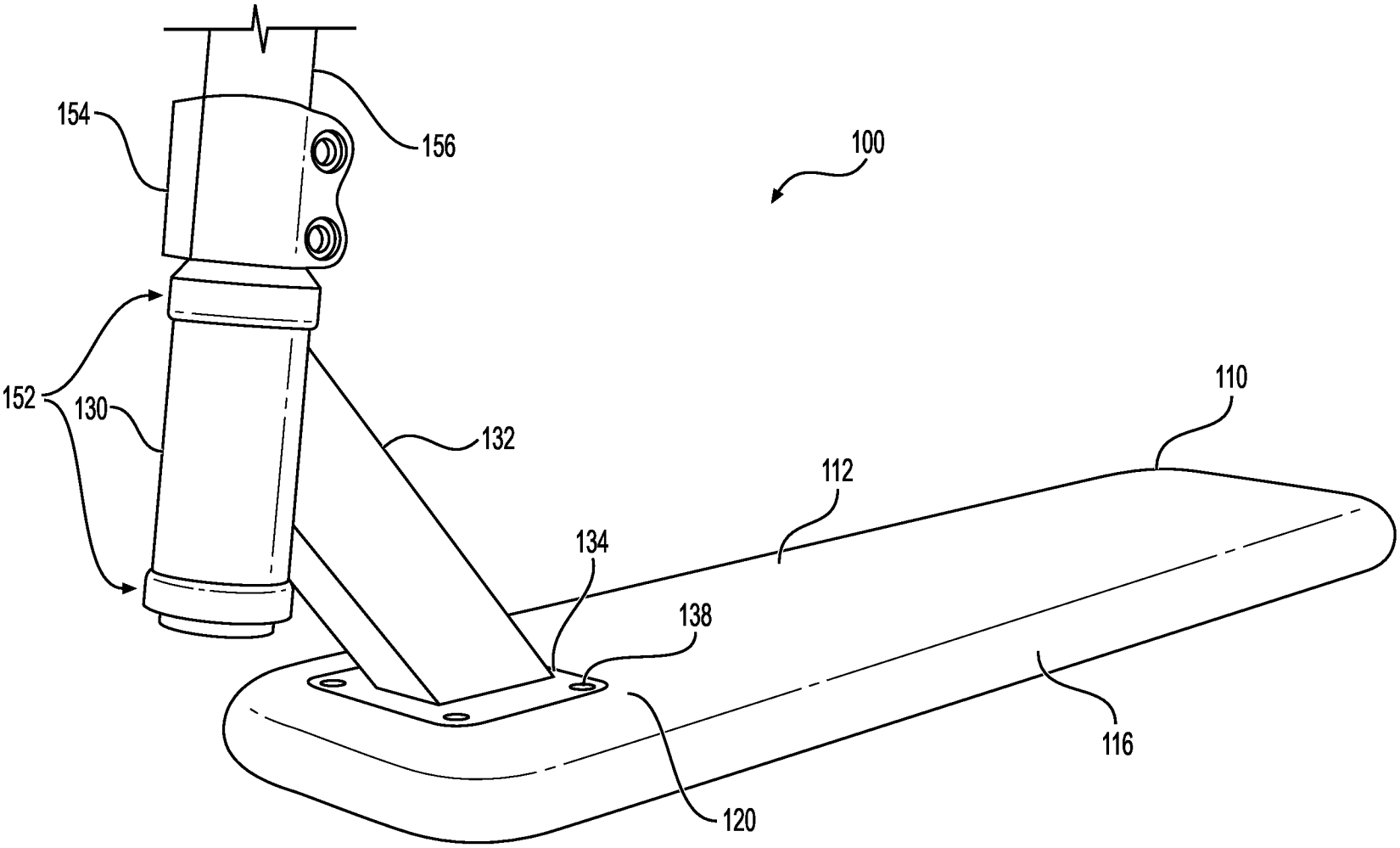
FIG. 3 is a detailed left side view of the attachment mechanism a trampoline scooter of FIG. 1.

FIG. 3 is a detailed side view of trampoline scooter 100 in accordance with some embodiments. The column 156, the fork 150, and the headtube 130 may extend beyond a front portion of the deck 110. The headtube 130 may be connected to neck 132 in such a way that the column 156 has a non-vertical upward angle. The column 156 may be tilted towards the rear of deck 110. The upper attachment member 134 may be placed within the upper recess 120 so that the top side of the upper attachment member 134 is flush with the upper surface of the deck 110. This arrangement is advantageous to riders so that their feet do not catch a portion of the upper attachment member 134 that protrudes above the upper surface 112 of the deck 110.

Figure 4:
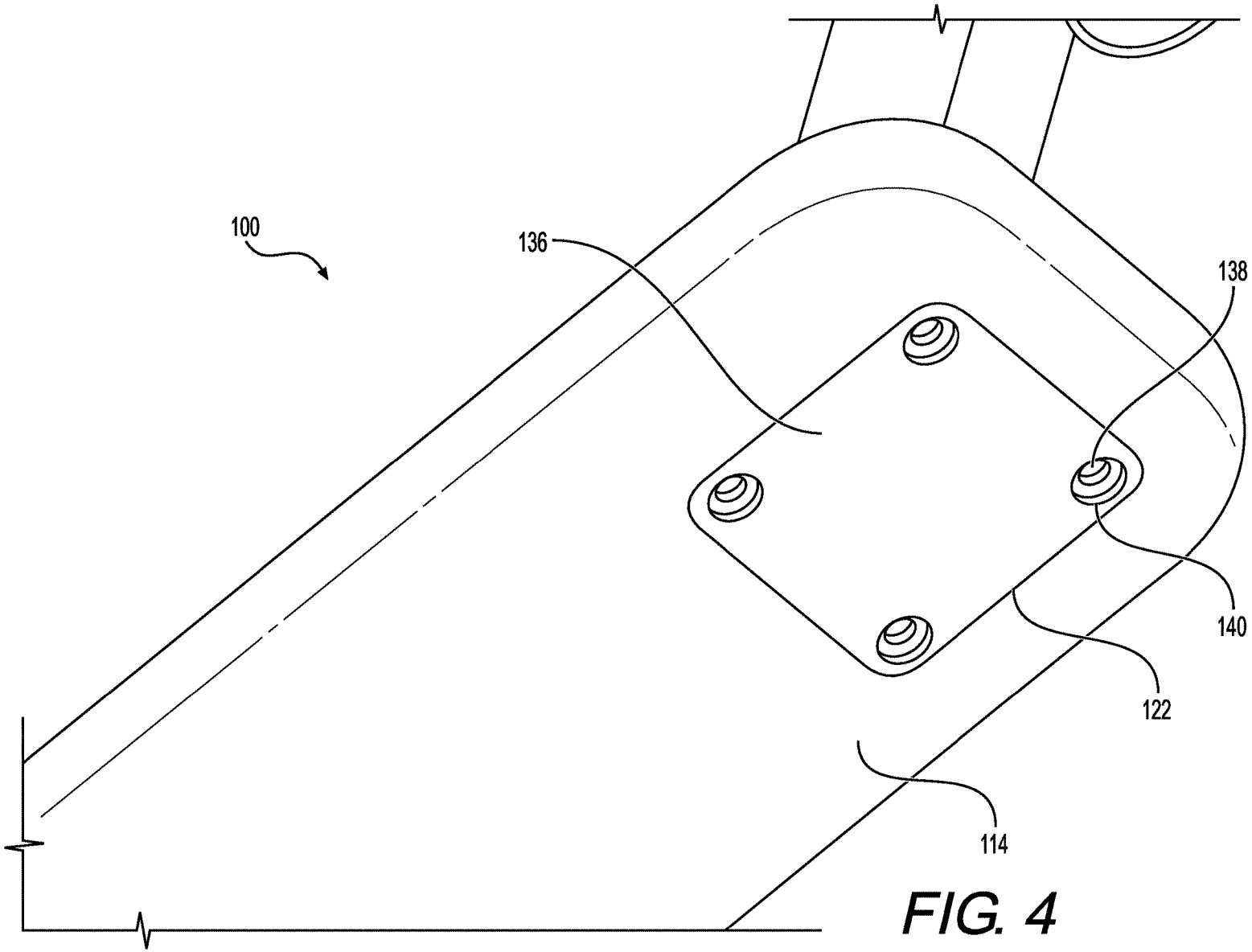
FIG. 4 is a detailed bottom view of the attachment mechanism a trampoline scooter of FIG. 1.

FIG. 4 is a detailed bottom view of the trampoline scooter 100 in accordance with some embodiments. The lower attachment member 136 may be placed within the lower recess 122 so that the bottom side of the lower attachment member 136 is flush with the lower surface 114 of the deck 110. The lower attachment member 136 may be received entirely by the lower recess 122 or may protrude from the lower recess 122 slightly. It is advantageous to prevent protrusions from the bottom of the board that could potentially damage the trampoline bed. Furthermore, the lower attachment member 136 may contain holes 138 with countersinks 140.

In some examples, the deck 110 may have an additional inner layer of material suspended within the foam. The outer layer of the deck 110 may be ethylene-vinyl acetate. This inner layer of material may be in the area just around the upper recess 120 and the lower recess 122 or may extend throughout the deck 110. The inner layer may be an additional layer of a harder of foam or a piece of metal or plastic to increase rigidity. The inner layer may be attached to the upper attachment member 134 by the connectors and may replace the lower attachment member 136 or the need for the lower recess 122. The inner layer may include a spine that runs a part of the length of the deck 110 or the entire length of the deck 110. The spine may be the width of the upper attachment member 134. The spine may be a composite structure surrounded by ethylene-vinyl acetate foam or a similar foam to maintain a soft edge to avoid injury. The spine may have a structure that is rigid while also being flexible enough to survive the strains of use.

The trampoline scooter 100, as disclosed in various examples, has several design benefits. First, examples employing a deck 110 of foam are superior to those having a metal deck because it is more comfortable to use on a trampoline. While metal decks, as found on conventional scooters, can damage trampoline mats, foam decks minimize damage inflicted on the trampoline mat during bouncing. Furthermore, metal decks can also hurt the feet of riders if the rider's foot is between the deck and the trampoline mat when bouncing. In this scenario, a foam deck would softly depress around the rider's foot, causing no injury. A metal deck could cause cuts and/or bruises. Additionally, many scooter tricks involve spinning the deck around while the rider holds onto the handlebars. This can mean that the deck frequently may, during practice, contact the rider's legs. If using a scooter with a metal deck, this is likely to cause injury to the rider's legs. Conversely, a foam deck is likely to bounce off the rider's leg and not cause injury or cause less injury. Further, the advantages of foam decks are increasingly apparent when multiple riders are bouncing on the same trampoline at once, as foam decks offer a significant safety advantage because they are not as hard as metal and have some ability to bend and absorb impacts. Foam decks are also lighter and easier to bounce with than metal decks.

Second, attaching the headtube 130 to the deck 110 in the manner described is significantly stronger than other methods. Using the upper attachment member 134 and the lower attachment member 136 to clamp the foam deck 110 distributes the load to the foam around the attachment location. This makes the deck 110 less likely to tear or break. If, for example, the column 156 was connected directly to the deck, its connection point to the foam is significantly more likely to break because the torque on the handlebars is exerted on a single attachment point. This twisting action causes the foam to bend and stretch in adverse ways when force is applied against the handlebars and would eventually result in failure of the mounting point of the column 156 to the foam deck 110. Conversely, the design of the disclosed trampoline scooter disclosed in example embodiments eliminates this problem by distributing the load with the upper attachment member 134 and lower attachment member 136.

Third, the configuration of the disclosed trampoline scooter 100 as disclosed in various examples is similar to conventional (wheeled) scooter, which makes it easier for the rider to learn tricks and then transition back to riding a conventional scooter. By using the disclosed column 156 and attachment assembly, using the trampoline is a more realistic practice experience for the rider. The disclosed trampoline scooter 100 is designed to have the same feel and balance of a wheeled scooter. This means that the rider can reliably learn the tricks on a trampoline using the disclosed trampoline scooter 100 and there is no 'learning curve' when the rider attempts the same tricks on a wheeled scooter. It would be very frustrating to riders if a trampoline scooter had different physical attributes that prevented tricks learned on the trampoline scooter from translating to the wheeled scooter (e.g., if the handlebars and column were connected directly to the deck).

Fourth, the disclosed trampoline scooter 100 as disclosed in various embodiments is easier to repair if parts break. If, for example, the column 156 was connected directly to the foam deck 110 and the foam deck 110 was broken, the entire trampoline scooter 100 would have to be replaced, as it would be impractical for a rider to repair a torn foam deck 110. Because the trampoline scooter 100 disclosed in some examples has the upper attachment member 134 and lower attachment member 136 connected by connectors, it is easy and convenient for the rider to replace individual parts (e.g., a new deck) without requiring special tools. This is less expensive and wasteful than replacing the entire trampoline scooter 100 if it was broken. Furthermore, this also allows for additional customization that can be performed by the rider (e.g., replacing the foam deck 110 with one of a different color).

In some examples, disclosed systems or methods may involve one or more of the following clauses:

Clause 1: A trampoline scooter, comprising: a deck having an upper surface and a lower surface, an upper recess defined in the upper surface and a lower recess defined in the lower surface; an upper attachment member having a top side, wherein the upper attachment member is at least partially received within the upper recess; a lower attachment member, wherein the lower attachment member is at least partially received within the lower recess; one or more connectors extending through at least a portion of the deck, the upper attachment member, and the lower attachment member; a neck having a first end and a second end, the first end attached the top side of the upper attachment member; a headtube assembly attachable to the second end of the neck; a column connected to the headtube assembly; and a handlebar connected to the column.

Clause 2: A trampoline scooter of clause 1, wherein the upper attachment member is entirely positioned within the upper recess.

Clause 3: A trampoline scooter of clause 1, wherein the lower attachment member is entirely positioned within the lower recess.

Clause 4: A trampoline scooter of clause 3, wherein the lower attachment member has a substantially planar bottom side, the lower surface of the deck is substantially planar, and the lower attachment member is positioned within the lower recess such that the substantially planar bottom side of the lower attachment member is flush with the lower surface of the deck.

Clause 5: A trampoline scooter of clause 3, where in the lower attachment member has a convex bottom side, the lower surface of the deck is convex, and the lower attachment member is positioned within the lower recess such that the convex bottom side of the lower attachment member is flush with the convex lower surface of the deck.

Clause 6: The trampoline scooter of clause 1, wherein the headtube assembly further comprises a receiver mechanism for receiving a segment of a fork, and the column is connected to the fork.

Clause 7: A trampoline scooter of clause 6, wherein a section of the receiver mechanism extends beyond a front of the deck.

Clause 8: The trampoline scooter of clause 1, wherein at least one of the upper attachment member and the lower attachment member contains one or more countersunk holes.

Clause 9: The trampoline scooter of clause 1, wherein the deck is ethylene-vinyl acetate foam.

Clause 10: A trampoline scooter of clause 1, wherein the connectors are bolts having a threaded section and a head section, and the trampoline scooter further comprises a plurality of protective covers each extending over the head section of one of the respective bolts.

Clause 11: The trampoline scooter of clause 10, wherein the upper attachment member contains one or more threaded holes, and the threaded section of the bolts are inserted through one or more holes in the lower attachment member and one or more holes in the deck to be in selective communication with the threaded holes of the upper attachment member.

Clause 12: The trampoline scooter of clause 1, wherein the lower attachment member contains one or more threaded studs, and the studs are inserted through one or more holes in the deck and one or more holes in the upper attachment member.

Clause 13: A trampoline scooter, comprising: a deck having an upper surface and a lower surface, an upper recess defined in the upper surface and a lower recess defined in the lower surface; an upper attachment member having a top side, wherein the upper attachment member is at least partially received within the upper recess; a lower attachment member, wherein the lower attachment member is at least partially received within the lower recess; one or more connectors connecting the upper attachment member, the lower attachment member, and the deck; a neck having a first end and a second end, the first end attached the top side of the upper attachment member; and a headtube attached to the second end of the neck.

Clause 14: The trampoline scooter of clause 13, further comprising a column and a handlebar, wherein the handlebar comprises grips and endcaps.

Clause 15: The trampoline scooter of clause 13, wherein the deck further comprises one or more side surfaces forming at least a first fillet corner with the upper surface and at least a second fillet corner with the lower surface.

Clause 16: The trampoline scooter of clause 13, wherein the neck has a rectangular lateral cross-section at the first end.

Clause 17: The trampoline scooter of clause 13, wherein the lower attachment member and the upper attachment member are shaped as rectangular prisms with curved corners.

Clause 18: A trampoline scooter, comprising: a deck made of a flexible, non-metallic material comprising an upper surface and a lower surface, an upper recess defined in the upper surface; an upper attachment member having a top side, wherein the upper attachment member is at least partially received in the upper recess; a neck having a first end and a second end, the first end attached the top side of the upper attachment member; and a headtube attached to the second end of the neck.

Clause 19: The trampoline scooter of clause 18, wherein the deck has an outer layer and one or more inner layers of a non-flexible material at least in an area surrounding the upper recess, and the one or more inner layers is attached to the upper attachment member and the deck by one or more connectors.

Clause 20: The trampoline scooter of clause 19, wherein the outer layer of the deck is made of ethylene-vinyl acetate foam with an additional non-flexible material suspended within the foam for rigidity.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Although embodiments are described herein with respect to systems or methods, it is contemplated that embodiments with identical or substantially similar features may alternatively be implemented as systems and/or methods.

As used herein, unless otherwise specified, the use of the ordinal adjectives "first," "second," "third," etc., to describe a common object, merely indicates that different instances of like objects are being referred to, and is not intended to imply that the objects so described must be in a given sequence, either temporally, spatially, in ranking, or in any other manner.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A trampoline scooter, comprising:

a deck having an upper surface and a lower surface, an upper recess defined in the upper surface and a lower recess defined in the lower surface;

an upper attachment member having a top side, wherein the upper attachment member is at least partially received within the upper recess;

a lower attachment member, wherein the lower attachment member is at least partially received within the lower recess;

one or more connectors extending through at least a portion of the deck, the upper attachment member, and the lower attachment member;

a neck having a first end and a second end, the first end attached the top side of the upper attachment member;

a headtube assembly attachable to the second end of the neck;

a column connected to the headtube assembly; and a handlebar connected to the column.

2. The trampoline scooter of claim 1, wherein the lower attachment member is entirely positioned within the lower recess.

3. The trampoline scooter of claim 2, wherein the lower attachment member has a planar bottom side, the lower surface of the deck is planar, and the lower attachment member is positioned within the lower recess such that the planar bottom side of the lower attachment member is flush with the lower surface of the deck.

4. The trampoline scooter of claim 2, where in the lower attachment member has a convex bottom side, the lower surface of the deck is convex, and the lower attachment member is positioned within the lower recess such that the convex bottom side of the lower attachment member is flush with the convex lower surface of the deck.

5. The trampoline scooter of claim 1, wherein the headtube assembly further comprises a receiver mechanism for receiving a segment of a fork, and the column is connected to the fork.

6. The trampoline scooter of claim 5, wherein a section of the receiver mechanism extends beyond a front of the deck.

7. The trampoline scooter of claim 1, wherein the one or more connectors are bolts having a threaded section and a head section, and the trampoline scooter further comprises a plurality of protective covers each extending over the head section of one of the respective bolts.

8. The trampoline scooter of claim 7, wherein the upper attachment member contains one or more threaded holes, and the threaded section of the bolts are inserted through one or more holes in the lower attachment member and one or more holes in the deck to be in selective communication with the threaded holes of the upper attachment member.

9. The trampoline scooter of claim 1, wherein the upper attachment member is entirely positioned within the upper recess.

10. The trampoline scooter of claim 1, wherein at least one of the upper attachment member and the lower attachment member contains one or more countersunk holes.

11. The trampoline scooter of claim 1, wherein the deck is ethylene-vinyl acetate foam.

12. The trampoline scooter of claim 1, wherein the lower attachment member contains one or more threaded studs, and the one or more threaded studs are inserted through one or more holes in the deck and one or more holes in the upper attachment member.

13. A trampoline scooter, comprising:

a deck having an upper surface and a lower surface, an upper recess defined in the upper surface and a lower recess defined in the lower surface;

an upper attachment member having a top side, wherein the upper attachment member is at least partially received within the upper recess;

a lower attachment member, wherein the lower attachment member is at least partially received within the lower recess;

one or more connectors connecting the upper attachment member, the lower attachment member, and the deck;

a neck having a first end and a second end, the first end attached the top side of the upper attachment member; and a headtube attached to the second end of the neck.

14. The trampoline scooter of claim 13, further comprising a column and a handlebar, wherein the handlebar comprises grips and endcaps.

15. The trampoline scooter of claim 13, wherein the deck further comprises one or more side surfaces forming at least a first fillet corner with the upper surface and at least a second fillet corner with the lower surface.

16. The trampoline scooter of claim 13, wherein the neck has a rectangular lateral cross-section at the first end.

17. The trampoline scooter of claim 13, wherein the lower attachment member and the upper attachment member are shaped as rectangular prisms with curved corners.

18. A trampoline scooter, comprising:

a deck comprising an outer layer and one or more inner layers, wherein the outer layer is made of a flexible, non-metallic material comprising an upper surface and a lower surface, an upper recess defined in the upper surface;

an upper attachment member having a top side, wherein the upper attachment member is at least partially received in the upper recess;

one or more connectors extending through at least a portion of the deck and the upper attachment member, the one or more connectors attaching the upper attachment member to at least one of the one or more inner layers;

a neck having a first end and a second end, the first end attached the top side of the upper attachment member; and a headtube attached to the second end of the neck.

19. The trampoline scooter of claim 18, wherein the one or more inner layers comprise a non-flexible material at least in an area surrounding the upper recess.

20. The trampoline scooter of claim 19, wherein the outer layer of the deck is made of ethylene-vinyl acetate foam with an additional non-flexible material suspended within the foam for rigidity.

* * * * *